US005301388A

United States Patent [19]

Zeren

[11] Patent Number: 5,301,388

[45] Date of Patent: Apr. 12, 1994

[54] CRITICALLY SAFE VACUUM PICKUP FOR USE IN WET OR DRY CLEANUP OF RADIOACTIVE MATERIALS

[76] Inventor: Joseph D. Zeren, 390 Forest Ave., Boulder, Colo. 80304

[21] Appl. No.: 985,372

[22] Filed: Dec. 4, 1992

[51] Int. Cl.[5] ..... A47L 9/12

[52] U.S. Cl. ..... 15/327.1; 15/327.3; 15/327.6; 15/347; 15/328; 55/216; 55/429

[58] Field of Search ..... 15/327.1, 347, 352, 15/353, 328, 327.3, 327.6; 55/216, 342, 372, 472, 429

[56] References Cited

U.S. PATENT DOCUMENTS

| | | | |
|---|---|---|---|
| 3,308,609 | 3/1967 | McCulloch et al. | 15/327.1 |
| 3,894,364 | 7/1975 | Korn et al. | 51/320 |
| 4,061,480 | 12/1977 | Frye et al. | 55/356 |
| 4,287,635 | 9/1981 | Jacobs | 15/328 |
| 4,718,924 | 1/1988 | DeMarco | 55/302 |
| 4,723,969 | 2/1988 | DeMarco | 55/97 |
| 4,820,315 | 4/1989 | DeMarco | 55/337 |
| 4,894,881 | 1/1990 | Palmer et al. | 15/328 |
| 4,939,809 | 7/1990 | Park | 15/328 |
| 4,963,172 | 10/1990 | DeMarco | 55/337 |
| 5,180,407 | 1/1993 | DeMarco | 55/302 |

*Primary Examiner*—Philip R. Coe
*Assistant Examiner*—Patrick F. Brinson
*Attorney, Agent, or Firm*—Francis A. Sirr; Earl C. Hancock

[57] ABSTRACT

A vacuum pickup of critically safe quantity and geometric shape is used in cleanup of radioactive materials. Collected radioactive material is accumulated in four vertical, parallel, equally spaced canisters arranged in a cylinder configuration. Each canister contains a filter bag. An upper intake manifold includes four 90 degree spaced, downward facing nipples. Each nipple communicates with the top of a canister. The bottom of each canister communicates with an exhaust manifold comprising four radially extending tubes that meet at the bottom of a centrally located vertical cylinder. The top of the central cylinder terminates at a motor/fan power head. A removable HEPA filter is located intermediate the top of the central cylinder and the power head. Four horizontal bypass tubes connect the top of the central cylinder to the top of each of the canisters. Air enters the vacuum cleaner via a hose connected to the intake manifold. Air then travels down the canisters, where particulate material is accumulated in generally equal quantities in each filter bag. Four air paths of bag filtered air then pass radially inward to the bottom of the central cylinder. Air moves up the central cylinder, through the HEPA filter, through a vacuum fan compartment, and exits the vacuum cleaner. A float air flow valve is mounted at the top of the central cylinder. When liquid accumulates to a given level within the central cylinder, the four bypass tubes, and the four canisters, suction is terminated by operation of the float valve.

11 Claims, 3 Drawing Sheets

CRITICALLY SAFE VACUUM PICKUP FOR USE IN WET OR DRY CLEANUP OF RADIOACTIVE MATERIALSBACKGROUND OF THE INVENTION

1. Field of the Invention

This invention relates to the field of vacuum cleaners or pickups, and, more particularly, to vacuum cleaners that are especially constructed and arranged for the cleanup of wet or dry radioactive materials, such as plutonium oxide.

2. Description of Related Art

Cleanup of radioactive material is addressed in the art. For example, U.S. Pat. No. 4,061,480 provides a vacuum cleaner having a head section housing a motor and a fan. The head section sits on top of a filter unit comprising a filter cartridge, and a bag that comprises a primary filter for the cartridge. The filter unit is contained within a bladder that is impervious to air. Intake to the cleaner comprises an intake port connected to the area enclosed by the bladder. In this way, the material collected by the vacuum cleaner may be disposed of by unitary removing of the bladder and the filter unit.

The problem of hazardous material cleanup of wet or dry material has been addressed in the art. For example, U.S. Pat. No. 4,894,881 provides an open top base reservoir that contains a collection bag, the collection bag being used only for dry cleanup situations. An adapter unit sits on top of the base member. The upper portion of the adapter unit contains a vacuum motor that draws air from within the collection bag, first through a cloth filter bag, and then through a HEPA filter. A ball valve is positioned between the collection bag and the cloth filter bag to interrupt air flow when the base member is full of wet or liquid material.

U.S. Pat. No. 3,894,364 relates to the general field of the cleaning of contaminated areas, such as nuclear power plants.

The prior art has provided dust collectors having multiple compartments. For example, U.S. Pat. No. 4,718,924 describes a two compartment, four stage, dust collector. In this device, dust-laden air passes sequentially through a cyclone stage, a solids/gas separation stage, and a four-canister filter stage.

While these devices are generally suitable for their diverse intended purposes, such as in situations of low radiation level, the need remains in the art for a critically safe volume vacuum cleaner for use in the wet or dry cleanup of radioactive workspaces, and particularly, for the pickup of plutonium and other high radiation level uses.

SUMMARY OF THE INVENTION

It is known that for reasons of safety, containers for radioactive materials must be made of a defined class of materials that meet defined geometric and capacity criteria.

This invention provides a vacuum cleaner or pickup that is constructed and arranged to ensure that collected radioactive material is accumulated at fixed positions in a multiple (i.e., four) canister configuration that provides multiple volumes of radioactive particulate having a critically safe capacity and geometric shape. In addition, the spacing between the individual canisters provides a safe geometry. A primary use for devices constructed and arranged in accordance with the invention is the manual cleanup of either wet or dry radioactive material, such as plutonium oxide.

In a preferred embodiment, the vacuum pickup of this invention comprises an upper, generally horizontal, generally circular, intake manifold having four 90-degree spaced, downward facing, outlet ports or nipples, each port communicating with the top of one of four generally vertical, generally cylindrical, chambers or canisters. Each of the four canisters contain a removable cloth filter bag that conforms generally to the cylindrical shape of its canister.

Each canister individually provides a safe and limited dry material capacity of about 7.1 liters (i.e., a total dry capacity of about 28.4 liters) when using the filter bags. A total liquid capacity of about 40.9 liters is provided when the filter bags are not used. The collected radioactive material is maintained in a volume whose shape comprises a critically safe geometry. The spacing between the canisters additionally provides a safe geometric configuration for the total accumulation of radioactive particles.

The bottom of each canister communicates with an X-shaped exhaust manifold comprising four generally horizontal, inward directed, radially extending tubes that meet at the bottom of a centrally located, generally vertical cylinder or tube. The top of the central cylinder terminates at a motor/fan power head providing an exemplary air flow of about 184 CFM. The input of the power head includes a removable nuclear grade HEPA filter. Since the air entering the fan housing is HEPA filtered, the housing need not include special leak-tight seals. The presence of the HEPA filter enables the vacuum pickup to be used inside, or outside, of a radioactive workspace enclosure. Four generally horizontal air bypass tubes connect the upper portion of the central cylinder to the upper portion of each of the four canisters. These bypass tubes operate to allow air, or suction, to pass directly to the power head from the intake manifold as the canisters and the central cylinder fill with liquid.

Air enters the vacuum pickup via a hose that connects to the intake manifold. Four generally equal volume, equal velocity, and parallel air paths travel down the four canisters, where particulate material is accumulated in generally equal quantities in each filter bag. Four air paths of bag-filtered air then pass radially and generally horizontally inward to the bottom of the central cylinder. Air then moves up the central cylinder, through the HEPA filter, through a power head fan compartment, and then exits the vacuum cleaner. A sound muffler may be provided at this air exit point, and an additional filter may be used when the device is used to pickup toxic, or the like, hazardous material.

Preferably, the various parts of the vacuum cleaner are fabricated from stainless steel. Radioactive particulate clean out of the vacuum cleaner is facilitated by removal of the four filter bags. Liquid is removed by way of a valve that is located at the bottom of the device.

When wet areas are to be cleaned of radioactive material, it is preferable not to use filter bags within the four canisters. In this case, radioactive liquid collects in the central cylinder, as well as in the four spaced canisters. Gathered liquid is removed by way of the bottom valve, as the liquid is drained into special "pencil" type storage tanks. For use in this type of cleanup, a float type air flow ball valve is mounted at the top portion of the central cylinder. When liquid accumulates to a given level in the central cylinder, the bypass tubes and the canisters, the float valve closes, and suction at the pickup's intake is terminated.

As a result of the above construction and arrangement, the vacuum cleaner of the invention operates to maintain a critically safe volumetric configuration for gathered radioactive material. A feature of the invention is that neutron absorbing means, such as the well-known boron Raschig rings that are usually required in a vacuum cleaner of this utility, are not required in cleaners that are constructed in accordance with the invention, thus providing an unusual reduction in size, weight, and material disposal time, while at the same time providing increased device capacity and mobility.

These and other of objects and advantages of the invention will be apparent to those of skill in the art upon reference to the following detailed description, which description makes reference to the drawing.

DETAILED DESCRIPTION OF THE INVENTION

Figure 1:
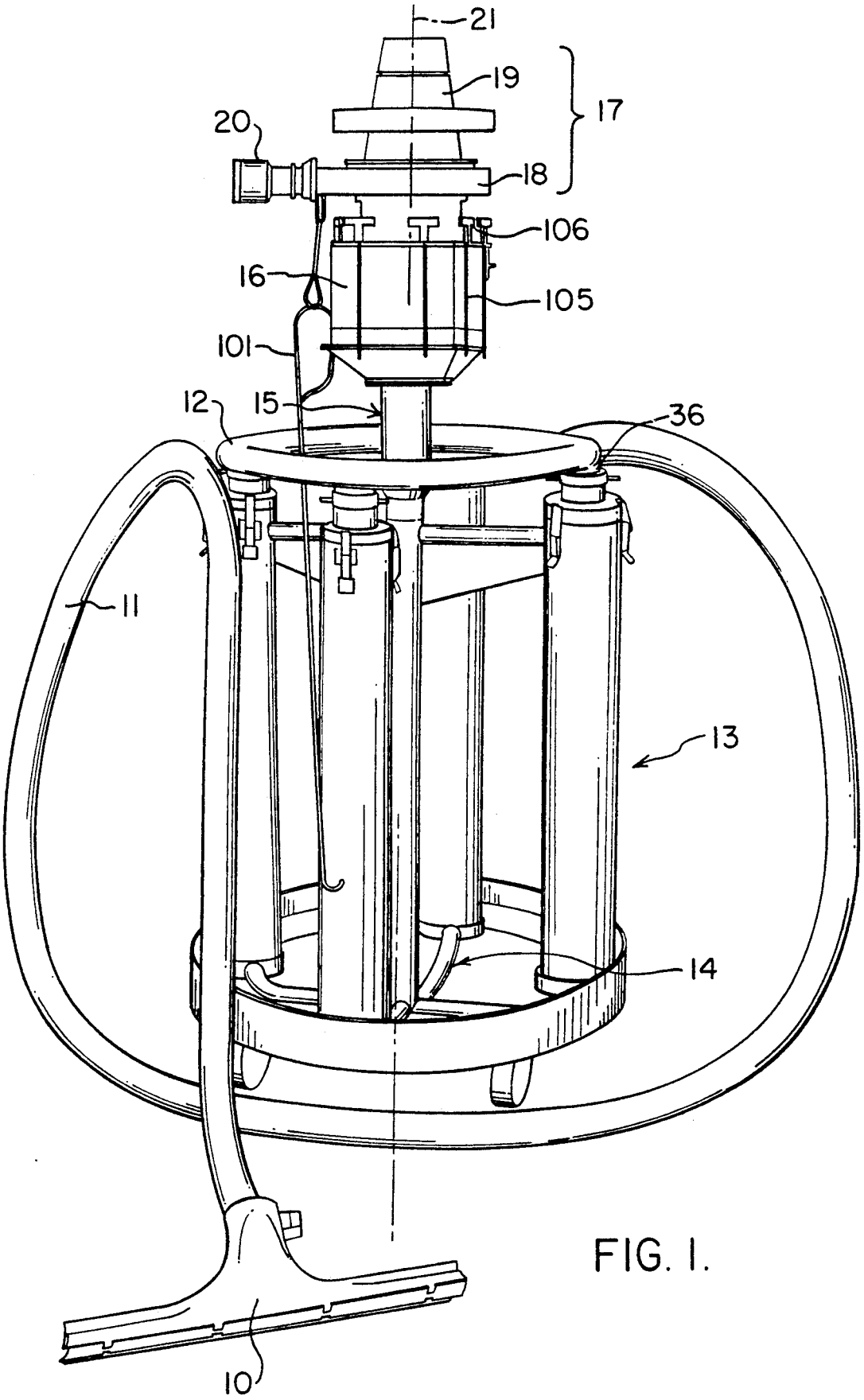
FIG. 1 is a side perspective view of a caster mounted vacuum pickup in accordance with the invention.

FIG. 1 is a side perspective view of a caster-mounted vacuum pickup in accordance with the invention. The vertical height of this device is about six feet.

FIG. 1 shows a conventional vacuum nozzle 10 and hose 11 that connect to an annular (for example, circular) input manifold 12, preferably fabricated of stainless steel. The collection area generally identified by numeral 13 is occupied by four vertical, 90-degree spaced, stainless steel canisters, and a centrally located cylinder, as will be described in greater detail. The lower portion of the vacuum cleaner comprises a generally horizontal exhaust manifold area identified as 14. The upper 15 end of the above-mentioned central cylinder terminates at a float valve to be described, a HEPA filter 16 and a motor/fan(impeller) unit 17 comprising fan unit or housing 18, and an electrical motor unit or housing 19.

In the device of FIG. 1, the devices clean air outlet includes a noise muffler unit 20. The vacuum cleaner is generally symmetrical about its central axis 21.

As stated, the vacuum cleaner of this invention provides a construction and arrangement ensuring that collected radioactive material is accumulated in a manner providing a critically safe capacity and geometric shape; for example, filled to maximum capacity with wet or dry plutonium oxide.

While the intended use of the invention is not to be considered as a limitation thereon, a preferred embodiment of the invention is intended for use in the manual cleanup of either wet or dry radioactive material, such as may periodically exist in radioactive material work spaces. As will be apparent in accordance with the invention, collected radioactive material is maintained in multiple volumes whose individual and overall shapes comprises a critically safe capacity and geometric configuration.

Figure 2:
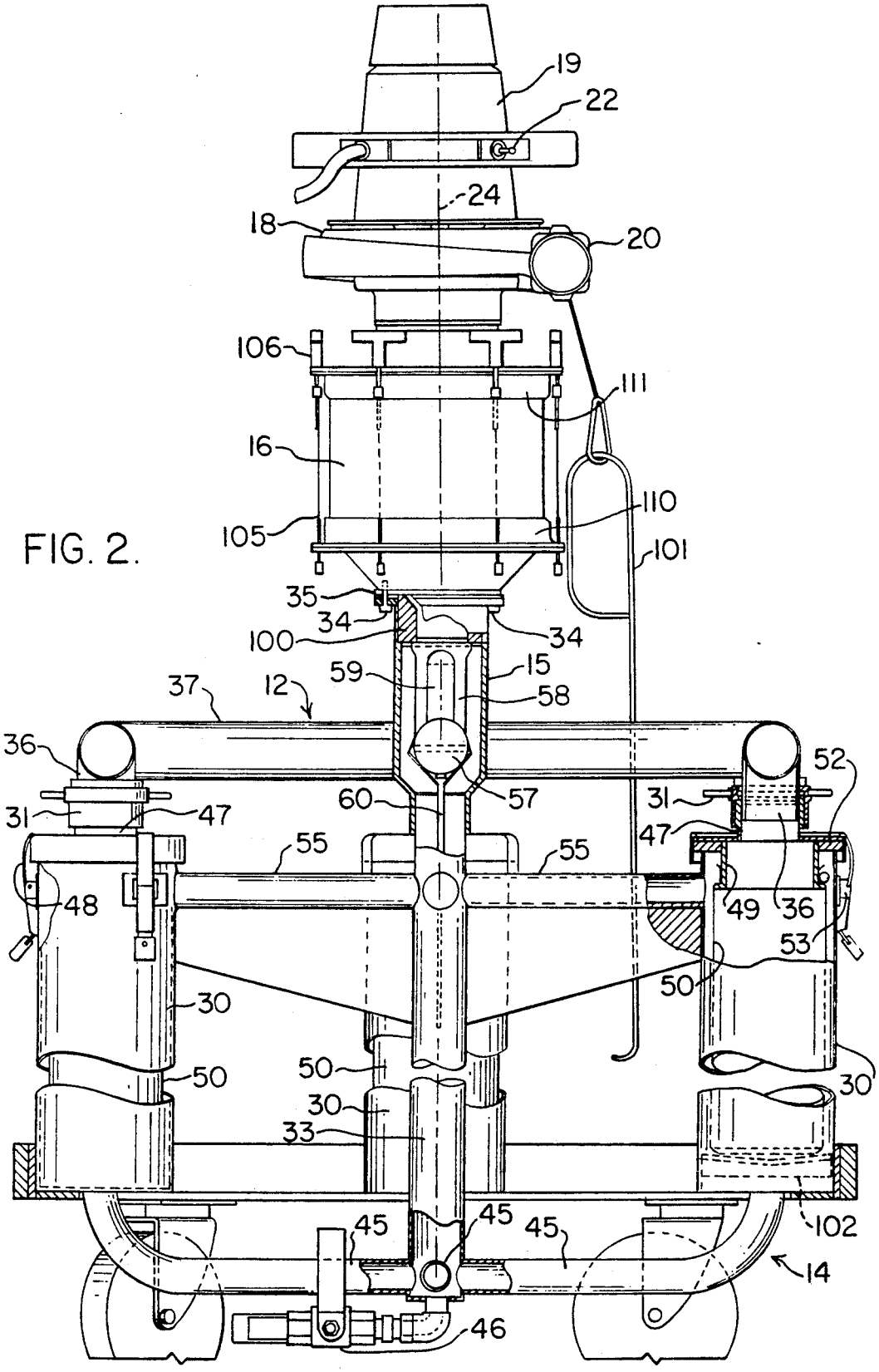
FIG. 2 is a partial vertical side section view and horizontal cutoff view of the device of FIG. 1 wherein the partial section is taken along the central axis of FIG. 1.

FIG. 2 is a partial side section view of the device of FIG. 1, taken along the central axis 21 thereof, wherein a horizontally-extending portion of collection area 13 has been cut away. FIG. 2 also shows the devices on/-off switch 22.

As shown in FIG. 2, the upper portion of the device is removable from the lower portion of the device. In this embodiment of the invention, the upper portion comprises two separate members; i.e., power head 17 and HEPA filter 16. Input manifold 12 is also removable from the lower portion of the device. Each of the four canisters 30 is connected to input manifold 12 by way of a manually rotatable compression coupler 31. Compression couplers 31 operate to hermetically seal the mechanical airflow connection between input manifold 12, and each of the four canisters 30 by compression of a rubber washer, or O-ring, 32 in a manner well known to those of skill in the art. While not normally removed, the upper portion 15 of central cylinder 33 may be uncoupled from power head 17 and HEPA filter 16 by removal of four bolts 34.

This portion of the device is hermetically sealed by compression of viton washer 35 in a well known manner.

Relative to FIG. 1, quick detachment and replacement of HEPA filter 16 is provided by the use of eight spring-loaded cables 105 having handles 106 thereon. Changing of filter bags 50 and HEPA filter 16 is accomplished in a special enclosed area.

When removal of the upper portion of the device is accomplished, as above described, motor/fan unit 17 and input manifold 12 are physically separated from the device's lower portion. As will be appreciated, it is not necessary to remove power unit 17 and HEPA filter 16 from central cylinder 33 in order to remove the filter bag from each of the four canisters 30.

It is preferable that intake manifold 12 be fabricated from stainless steel. Stainless steel is used to prevent corrosion by any of a variety of chemicals that may be contained in liquids to be picked up. It is also preferred that viton (fluorocarbon) O-rings and seals be used for this reason.

In a preferred embodiment of the invention, intake manifold 12 comprised a circular hollow tube 37 that occupied a generally horizontal plane, was about 24 inches minimum in manifold diameter, 2 inches in tube diameter, and included four vertical downward extending nipples 36 that were spaced at 90-degree intervals about the circumference of circular tube 37. As shown, nipples 36 extend within couplers 31 and are sealed thereto as described.

Each of the four canisters 30 includes a removable screen 102 at the bottom thereof. These screens function to collect debris that may be picked up when the device is used to pick up liquid from floors and the like. A stainless steel hook 101 is shown in FIG. 1 hanging from the left side of power head 17. Hook 101 is used to manually raise screens 102 from the bottom of canisters 30.

The lower portion of the device contains the device collection area generally identified by numeral 13. The outer circumference of collection area 13 is occupied by four quadrature spaced, vertically extending, and parallel canisters 30. Canisters 30 are preferable fabricated from stainless steel, and comprise circular cylinders about 34 inches high, about 5 inches in maximum diameter, each cylinder having a central axis (not numbered) that extends generally parallel the central axis 21 of the vacuum cleaner device.

Figure 3:
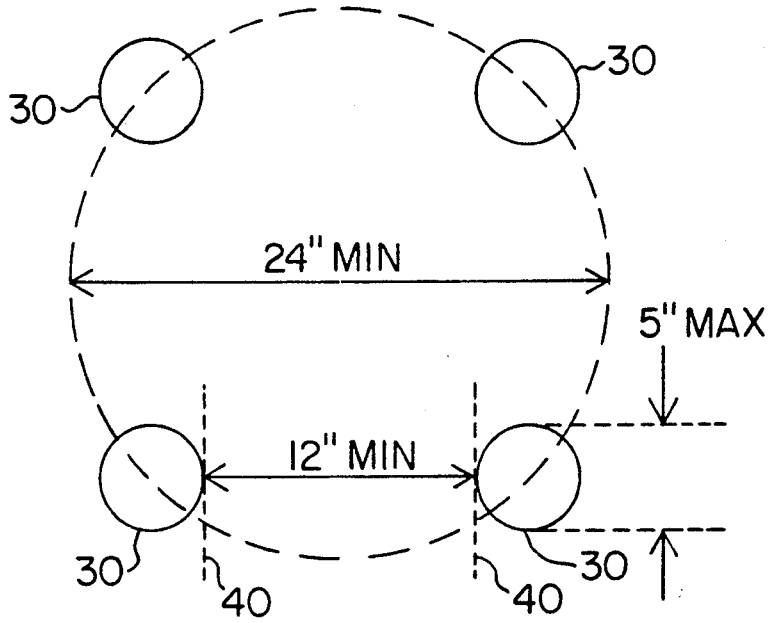
FIG. 3 is a top view showing the physical positioning of the four canisters of FIG. 1, this figure showing that each canister has a maximum diameter of 5 inches, each canister has a minimum edge-to-edge spacing of 12 inches, and for an embodiment of the invention having four canisters the four canisters are arranged at 90-degree intervals on a circle having a 24 inch minimum diameter.

FIG. 3 provides a general teaching of the manner in which canisters 30 are constructed and arranged for the pickup of radioactive material, such as plutonium 239 and the like. The vertical height of canisters 30 is not critical. However, for purposes of neutron reflection, it is desirable that the bottom of filter bags 50 be maintained at least 4.5 inches above the surface on which the vacuum cleaner rests. FIG. 3 shows that each individual canister 30 can have a diameter of no more than about 5 inches. Dotted lines 40 are drawn tangent to two adjacent canisters 30. FIG. 3 shows that each canister 30 must be spaced from its two adjacent canisters 30 by an edge-to-edge spacing of at least about 12 inches. This later requirement means that when four canisters are used, the canisters must be equally spaced about a circle having a diameter of at least 24 inches. When more than four canisters are to be used, this minimum edge-to-edge canister spacing of about 12 inches must be maintained. Thus, it is appreciated that when using a larger number of canisters (the canisters again being of a 5 inch maximum diameter and having a minimum degree-to-edge spacing of 12 inches), the canisters must be spaced about a circle having a diameter greater than 24 inches.

Referring again to FIG. 2, the device's centrally located cylinder 33 is also formed of stainless steel, and comprises a vertical circular cylinder whose axis coincides with the device's central axis 21. In an embodiment of the invention, cylinder 33 comprised a circular cylinder, or tube, of about a 2 inch diameter, about 37 inches in vertical height, and terminated in an upper end 15 of circular cross section having a vertical height of about 7 inches and a diameter of about 3⅜ inches. This upper portion of cylinder 33 includes a float air flow valve 60.

The sealed bottom ends of each of the four canisters 30 and central cylinder 33 are connected to exhaust manifold 14. Exhaust manifold 14 is formed as four radially inward extending stainless steel tubes that operate to provided four air flow paths, one from the bottom of each of the four canisters to the bottom of central cylinder 33. As a feature of the invention, exhaust manifold 14 includes a manual valve 46 that operates to drain liquid, sludge, and the like, from canisters 30 and cylinder 33. As will be appreciated, liquid is drained into specially designed, critically safe holding tanks.

As shown in FIG. 2, the lower lid portion 47 of each of the four couplers 31 is clamped to its canister 30 by operation of four manually-operated over-center clamps 48 of conventional construction. These four coupled areas are sealed by compression of four viton washers 52. Each of the coupler portions 47 contains a metal, downward extending, circular cylinder 49 to which a removable filter bag 50 is attached by operation of an a releasable attachment means; for example, by a stainless steel screw clamp, or by an elastic viton band 53. Filter bags 50 may comprise cloth filter bags that are formed of conventional heavy duty canvas cloth, such as BTM cloth, or of fiber glass. A utility for the invention is in the cleanup of dry radioactive materials. When used in this manner, all such relatively large particulate material is accumulated in a collection area comprising the four canisters 30 and, more particularly, in the four filter bags 50 contained in the four canisters 30. Filter bag material and mesh size is not critical, since all bag filters will leak minute size particles, and final filtering is accomplished by the use of the nuclear grade HEPA filter 16. Filter bag strength must be such as to reliably contain metal particles, such as metal weld and cutting particles, that are often picked up in contaminated equipment size reduction facilities.

A further utility for the vacuum cleaner of the invention is in the cleanup of fluid or liquid radioactive material. When used in this manner, it is preferable that filter bags 50 not be used. As a feature of the invention, this utility of the invention is enhanced by the provision of four horizontal, radially extending, stainless steel, air bypass tubes that operate to connect the upper end of cylinder 33 to the upper end of the four canisters 30, thus creating a suction air path that remains open as liquid fills the bottom of each canister 30. When the liquid level reaches the top of bypass tubes 55, liquid is drawn into float valve chamber 15, where hollow stainless steel ball 57 is raised to form a seal at viton ball seat 100 (see FIG. 2). Ball seat 100 is under compression and also serves to hold ball cage or retainer 58 in place.

As shown in FIG. 1, a stainless steel, vertically downward extending rod 60 is attached to the bottom of ball valve 57. The length of rod 60 is controlled to adjust the actuation weight, or specific gravity of ball 57. This feature prevents ball 57 from being lifted by air suction, and yet allows ball 57 to rise when contacted by liquid.

When the device of the invention is used to cleanup liquid waste, it is desirable to limit the amount of liquid that can be accumulated in collection area 13, and to prevent liquid from reaching HEPA filter 16. In order to provide this desirable function, the upper enlarged portion 15 of central cylinder 33 contains float-actuated ball valve 57 to provide a control of air flow. Ball valve 57 is loosely contained within metal cage 58 having four windows 59 formed therein. Movement of ball 57 within cage 58 is guided by weight adjustment rod 60 that freely passes through a hole formed in the bottom of cage 58. Hollow ball 57 is made by welding two stainless steel hemispheres together at a horizontal weld line. Rod 60 slides within a hole in cage 58, thus ensuring that the top, smooth and unwelded portion of ball 57 contacts viton seat 100.

From the above description of preferred embodiments of the invention, it can be seen that a vacuum pickup device is provided having a critically safe capacity and geometric shape for use in the cleanup of radioactive material, such as plutonium 239 oxide. Collected radioactive material is accumulated in a multiple canister configuration 30 that provides critically safe canister diameter, canister edge-to-edge spacing, and geometric location of the canisters. An upper intake manifold 12 includes a plurality of spaced outlet ports, or nipples 36, each port communicating with the top of one of the vertical canisters 30, each canister of which contains a filter bag 50. The bottom of each canister 30 communicates with an X-shaped exhaust manifold 14 comprising a plurality of radially extending tubes 45 that meet at the bottom of a centrally-located vertical cylinder 33. The top portion 15 of central cylinder 33 terminates at a motor/fan power head 17. The air flow input of power head 17 includes a removable HEPA filter 16. Air enters the vacuum cleaner via a hose 11 that connects to intake manifold 12. Air then travels down the canisters 30 in a plurality of generally equal air flow paths (i.e., equal CFM), where particulate material is accumulated in generally equal quantities in each canister filter bag 50. A plurality of air paths of bag filtered air then pass radially inward to the bottom of central cylinder 33. Air then moves up cylinder 33, through HEPA filter 16, through fan compartment 19, and then exits the vacuum cleaner. For use in wet cleanup, float ball valve 57 is mounted in the top of central cylinder 33. When liquid accumulates to a given level within cylinder 33, suction is automatically terminated.

While the invention has been described with reference to preferred embodiments thereof, it is apparent that those skilled in the art will readily visualize yet other embodiments that are within the spirit and scope of the invention. Thus, it is intended that the invention be limited only by the content of the following claims.

What is claimed is:

1. A vacuum cleaner for use in the cleanup of radioactive material, comprising;

a generally horizontal annular intake manifold having a cleanup hose connected thereto and having a plurality of vertically downward extending output nipples, said intake manifold defining a generally vertical central axis of the cleaner;

a like plurality of upward extending cylindrical canisters, each canister having an upper end connected to one of said nipples, and each canister containing an internal filter bag having an open end facing a nipple and a closed end adjacent to a lower end of a canister;

a generally horizontal exhaust manifold comprising a like plurality of tubes, one each being connected to one of said canisters and each or which extends radially inward toward said central axis;

a central cylinder coincident with said central axis having a lower end connected to said plurality of tubes; and a motor/fan unit connected to a top portion of said central cylinder for creating a vacuum through said cleanup hose.

2. The vacuum cleaner of claim 1 including a filter located intermediate said top portion of said central cylinder and said motor/fan unit.

3. The vacuum cleaner of claim 2 wherein said named pluralities equals the number four, wherein the diameter of said canisters is no greater than five inches, and wherein said canisters are mounted so as to provide a canister edge-to-edge spacing of at least 12 inches.

4. The vacuum cleaner of claim 3 including a liquid sensitive float operable to terminate suction of said motor/fan unit, said float being mounted in said top portion of said central cylinder.

5. The vacuum cleaner of claim 4 including four fluid flow tubes, each tube interconnecting a top portion of one of said four canisters to a top portion of said central cylinder.

6. A vacuum cleaner constructed and arranged to collect radioactive material such as $PuO_2$ in a critically safe volumetric and geometric configuration, comprising;

a generally horizontal and planar tube in the shape of a closed ring, said tube having an inlet port and having four outlet nipples that are spaced about said tube at generally 90-degree intervals, said nipples facing downward from the plane of said tube, and said tube defining a generally vertical axis that extends generally normal to the plane of said tube and having a cleanup hose connected to said inlet port, four vertically extending and cylindrical collection canisters, one canister being releasably connected to each of said nipples, four removable filter bags, one filter bag being releasably mounted in each of said canisters with an open end of the bag facing a nipple, a generally horizontal and planar exhaust manifold mounted below said canisters and comprising four elongated tubes, each of said elongated tubes having one end connected to the bottom of one of said canisters, and each of said tubes extending inward toward said vertical axis;

a vertically extending exhaust cylinder mounted coincident with said vertical axis, said exhaust cylinder having an open top and a closed bottom, the closed bottom of said exhaust cylinder being connected to each of said four elongated tubes; and a source of vacuum releasably connected to the open top of said exhaust cylinder for creating a vacuum through said cleanup hose.

7. The device of claim 6 wherein said source of vacuum comprised a fan unit and an electrically energizable motor unit for driving said fan unit.

8. The device of claim 7 including a HEPA filter mounted intermediate the top of said exhaust cylinder and said fan unit.

9. The device of claim 8 including a drain valve mounted at the closed bottom of said exhaust cylinder.

10. The device of claim 9 including a normally open liquid responsive float air valve mounted within said exhaust cylinder generally at the top thereof.

11. The device of claim 10 wherein said closed ring has a minimum diameter of about 24 inches and wherein said canisters have a minimum diameter of about 5 inches.

* * * * *